US007451087B2

(12) United States Patent
Case et al.

(10) Patent No.: US 7,451,087 B2
(45) Date of Patent: Nov. 11, 2008

(54) SYSTEM AND METHOD FOR CONVERTING TEXT-TO-VOICE

(75) Inventors: Eliot M. Case, Denver, CO (US); Richard P. Phillips, Salt Lake City, UT (US)

(73) Assignee: Qwest Communications International Inc., Denver, CO (US)

( * ) Notice: Subject to any disclaimer, the term of this patent is extended or adjusted under 35 U.S.C. 154(b) by 885 days.

(21) Appl. No.: 09/818,207

(22) Filed: Mar. 27, 2001

(65) Prior Publication Data

US 2002/0077821 A1 Jun. 20, 2002

Related U.S. Application Data

(60) Provisional application No. 60/241,572, filed on Oct. 19, 2000.

(51) Int. Cl.
*G10L 13/06* (2006.01)
*G10L 13/08* (2006.01)
*G10L 13/00* (2006.01)

(52) U.S. Cl. ..... 704/267; 704/260; 704/266

(58) Field of Classification Search ..... 704/260, 704/258

See application file for complete search history.

(56) References Cited

U.S. PATENT DOCUMENTS 4,692,941 A 9/1987 Jacks et al.
4,979,216 A 12/1990 Malsheen et al.
5,278,943 A 1/1994 Gasper et al.
5,384,893 A * 1/1995 Hutchins ..... 704/267
5,668,926 A 9/1997 Karaali et al.
5,737,725 A 4/1998 Case
5,758,323 A 5/1998 Case
5,774,854 A 6/1998 Sharman
5,832,432 A 11/1998 Trader et al.
5,850,629 A * 12/1998 Holm et al. ..... 704/260
5,878,393 A * 3/1999 Hata et al. ..... 704/260
5,905,972 A * 5/1999 Huang et al. ..... 704/268
5,913,193 A 6/1999 Huang et al.
5,949,961 A 9/1999 Sharman
5,960,395 A 9/1999 Tzirkel-Hancock
6,076,060 A 6/2000 Lin et al.
6,101,470 A 8/2000 Eide et al.
6,108,627 A * 8/2000 Sabourin ..... 704/243
6,115,686 A * 9/2000 Chung et al. ..... 704/260
6,144,939 A * 11/2000 Pearson et al. ..... 704/258
6,173,263 B1 1/2001 Conkie (Continued)

OTHER PUBLICATIONS

U.S. Appl. No. 09/818,172, Case, pending.

(Continued)

*Primary Examiner*—David R. Hudspeth
*Assistant Examiner*—Brian L Albertalli
(74) *Attorney, Agent, or Firm*—Brooks Kushman P.C.

(57) ABSTRACT

A method for converting text to concatenated voice by utilizing a digital voice library and a set of playback rules is provided. The method includes receiving and expanding text data to form a sequence of text and pseudo words. The sequence of text and pseudo words is converted into a sequence of speech items, and the sequence of speech items is converted into a sequence of voice recordings. The method includes generating voice data on the sequence of voice recordings by concatenating adjacent recordings in the sequence of voice recordings.

9 Claims, 11 Drawing Sheets

U.S. PATENT DOCUMENTS 6,175,821 B1 1/2001 Page et al.
6,366,883 B1 4/2002 Campbell et al.
6,438,522 B1 8/2002 Minowa et al.
6,499,014 B1 12/2002 Chihara
6,600,814 B1 7/2003 Carter et al.
6,601,030 B2 * 7/2003 Syrdal ..... 704/258
6,665,641 B1 * 12/2003 Coorman et al. ..... 704/260

OTHER PUBLICATIONS

U.S. Appl. No. 09/818,331, Case et al., pending.
U.S. Appl. No. 09/818,968, Case et al., pending.
U.S. Appl. No. 09/818,208, Case et al., pending.

* cited by examiner

| WORD | "ACTION" | | "FUNCTION" | | "COMPOUNDING" | |
|---|---|---|---|---|---|---|
| TEXT INPUT AS KNOWN WORDS OR LITERALLY SPELLED BY SYLLABLE (50) | AC | TION | FUNC | TION | "COMPOUND" | ING |
| SPOKEN OUTPUT AS PRE-RECORDED WORDS OR PHONETICALLY SPELLED BY SYLLABLE (52) | AK | SHUHN | FUHNK | SHUHN | "COMPOUND" | EHNG |

SYSTEM AND METHOD FOR CONVERTING TEXT-TO-VOICE

CROSS-REFERENCE TO RELATED APPLICATIONS

This application claims the benefit of U.S. provisional application Ser. No. 60/241,572 filed Oct. 19, 2000.

BACKGROUND OF THE INVENTION

1. Field of the Invention

The present invention relates to a system and method for converting text-to-voice.

2. Background Art

Systems and methods for converting text-to-speech and text-to-voice are well known for use in various applications. As used herein, text-to-speech conversion systems and methods are those that generate synthetic speech output from textual input, while text-to-voice conversion systems and methods are those that generate a human voice output from textual input. In text-to-voice conversion, the human voice output is generated by concatenating human voice recordings. Examples of applications for text-to-voice conversion systems and methods include automated telephone information and Interactive Voice Response (IVR) systems.

SUMMARY OF THE INVENTION

It is, therefore, an object of the present invention to provide a method for converting text to concatenated voice by utilizing a digital voice library and a set of playback rules.

In carrying out the above object, a method for converting text to concatenated voice by utilizing a digital voice library and a set of playback rules is provided. The digital voice library includes a plurality of speech items and a corresponding plurality of voice recordings. Each speech item corresponds to at least one available voice recording. The method comprises receiving text data, expanding the text data to form a sequence of text and pseudo words, converting the sequence of text and pseudo words into a sequence of speech items in accordance with the digital voice library, and converting the sequence of speech items into a sequence of voice recordings in accordance with the set of playback rules. The method further comprises generating voice data based on the sequence of voice recordings by concatenating adjacent recordings in the sequence of voice recordings.

In preferred embodiments, expanding the text data further comprises additional steps. For example, expanding the text data may include searching the text data for an abbreviation and expanding any abbreviation contained in the text data into at least one pseudo word. For example, expanding the text data may include searching the text data for a numerical suffix, and expanding any numerical suffix contained in the text data into at least one pseudo word. For example, expanding the text data may include searching the text data for a telephone number, and expanding any telephone number contained in the text data into at least one pseudo word. Further, for example, expanding the text data may include searching the text data for a number that includes a comma, and expanding any number that includes a comma contained in the text data into at least one pseudo word. And further, for example, expanding the text data may include searching the text data for an Internet mail address, and expanding any Internet mail address contained in the text data into at least one pseudo word. Even further, expanding the text data may include searching the text data for an Internet Universal Resource Locator, and expanding any Internet Universal Resource Locator in the text data into at least one pseudo word.

Further, in a preferred embodiment, the plurality of speech items includes a plurality of phrases, and converting the sequence of text and pseudo words further comprises parsing the sequence of text and pseudo words to determine any phrases. Further, preferably, the plurality of speech items includes a plurality of words, and converting the sequence of text and pseudo words further comprises parsing the sequence of text and pseudo words to determine any words. Further, in a preferred embodiment, the plurality of speech items includes a plurality of syllables, and converting the sequence of text and pseudo words further comprises parsing the sequence of text and pseudo words to determine any syllables.

The advantages associated with embodiments of the present invention are numerous. For example, methods of the present invention convert text to concatenated voice by utilizing a digital voice library and a set of playback rules, and include expanding text data to form a sequence of text and pseudo words.

The above object and other objects, features, and advantages of the present invention will be readily appreciated by one of ordinary skill in the art in the following detailed description of the best mode for carrying out the invention when taken in connection with the accompanying drawings.

DETAILED DESCRIPTION OF THE PREFERRED EMBODIMENT(S)

Figure 1:
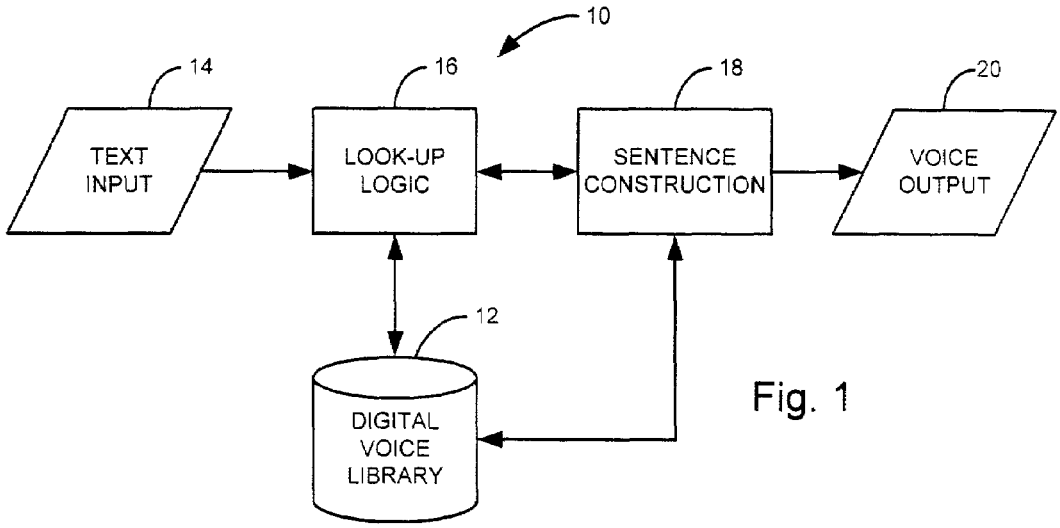
FIG. 1 is a simplified block diagram of a text-to-voice conversion system and method of the present invention, such as for use in an automated telephone information or IVR system.

One drawback of computer systems which provide synthetic text-to-speech conversion is that many times the synthetic speech that is generated sounds unnatural, particularly in that inflections that are normally employed in human speech are not accurately approximated in the audible sentences generated. One difficulty in providing a more natural sounding synthetic speech output is that in some existing systems and methods, words and inflection changes are based more upon the phoneme structure of the target sentence, rather than upon the syllable and phrase structure of the target sentence. Further, inflection and pitch changes are dependent not only on the syllable structure of the target word, but also the syllable structure of the surrounding words. Existing systems and methods for text-to-speech conversions do not include analysis which accounts for such syllable structure concerns.

One problem associated with existing systems and methods for text-to-voice conversion is that they are not capable of generating voice output for unknown text, such as words that have not been previously recorded or concatenated and stored. Such concatenated speech systems and methods have also ignored the type of audio content at the beginnings and endings of recordings, essentially butting one recording against another in order to generate the target output. While such a technique has been relatively successful, it has contributed to the unnatural quality of its generated output. Further, most systems and methods cannot produce the ligatures or changes that occur to the beginning or end of words that are spoken closely together.

Finally, existing concatenated speech systems and methods have historically been limited to outputting numbers and other commonly used and anticipated portions of an entire speech output. Typically, such systems and methods use a prerecorded fragment of the desired output up to the point at which a number or other anticipated piece is reached. The concatenation algorithms then generate only the anticipated portion of the sentence, followed by another prerecorded fragment used to complete the output.

Thus, there exists a need for a text-to-voice conversion system and method which accepts text as an input and provides high quality speech output through use of multiple recordings of a human voice in a digital voice library. Such a system and method would include a library of human voice recordings employed for generating concatenated speech, and would organize target words, word phrases and syllables such that their use in an audible sentence generated from a computer system would sound more natural. Such an improved text-to-voice conversion system and method would further be able to generate voice output for unknown text, and would manipulate the playback switch points of the beginnings and endings of recordings used in a concatenated speech application to produce optimal playback output. Such a system and method would also be capable of playing back various versions of recordings according to the beginning or ending phonemes of surrounding recordings, thereby providing more natural sounding speech ligatures when connecting sequential voice recordings. Still further, such a system and method would work over the entire length of the required output, without the limitation of only accounting for specific and anticipated portions of a required output, using inflection shape, contextual data, and speech parts as factors in controlling voice prosody for a more natural sounding generated speech output. Such a system and method also would not be limited to use with any particular audio format, and could be used, for example, with audio formats such as perceptual encoded audio, Linear Predictive Coding (LPC), Codebook Excited Linear Prediction (CELP), or other methods that are parametric or model based, or any other formats that may be used in either text-to-speech or text-to-voice systems.

Referring now to the FIG., the preferred embodiment of a system and method for converting text-to-voice of the present invention will be described. In general, the present invention includes a text-to-voice computer system and method which may accept text as an input and provide high quality speech output through use of multiple recordings of a human voice. According to the present invention, a digital voice library of human voice recordings is employed for generating concatenated speech output, wherein target words, word phrases and syllables are organized such that their use in an audible sentence generated by a computer may sound more natural. The present invention can convert text to human voice as a standalone product, or as a plug-in to existing and future computer applications that may need to convert text-to-voice. The present invention is also a potential replacement for synthetic text-to-speech systems, and the digital voice library element can act as a resource for other text-to-voice systems. It should also be noted that the present invention is not limited to use with any particular audio format, and may be used, for example, with audio formats such as perceptual encoded audio, Linear Predictive Coding (LPC), Codebook Excited Linear Prediction (CELP), or other methods that are parametric or model based, or any other formats that may be used in either text-to-speech or text-to-voice systems.

More specifically, referring to FIG. 1, a simplified block diagram of a preferred system and method for converting text-to-voice of the present invention is shown, such as for use in an automated telephone information or IVR system, denoted generally by reference numeral 10. As seen therein, the present invention generally includes a digital voice library (12), which is an asset database that includes human voice recordings of syllables, words, phrases, and sentences in a significant number of voiced inflections as needed to produce a more natural sounding voice output than the synthetic output generated by existing text-to-speech systems and methods. In operation, the present invention performs analysis of incoming text (14), and accesses digital voice library (12) via look-up logic (16) for voice recordings with the desired prosody or inflection, and pronunciation. The present invention then employs sentence construction algorithms (18) to concatenate together spoken sentences or voice output (20) of the text input.

Figure 2:
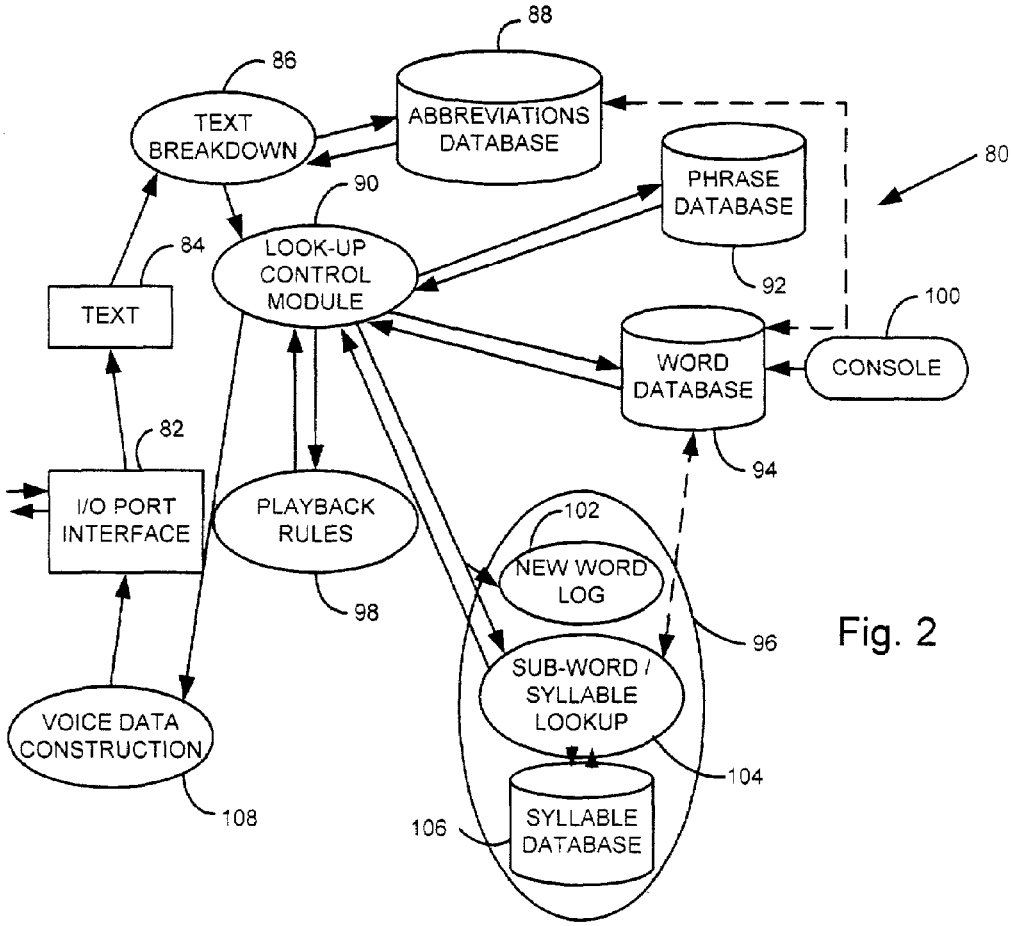
FIG. 2 is an architectural and flow diagram of the text-to-voice conversion system and method of FIG. 1.

Referring now to FIG. 2, the architecture and flow of a preferred text-to-voice conversion system and method of the present invention are shown, denoted generally by reference numeral 80. As seen therein, generally, using the previously described digital voice library, various look-ups are performed, such as for words or syllables, to assemble the appropriate corresponding speech output data. Using playback rules, such speech output data is concatenated in order to generate voice output. More particularly, input text is received at input/output port interface (82) in the form of words, abbreviations, numbers and punctuation (84) and may be in the form of text blocks, a text stream, or any other suitable form. Such text is then broken down, expanded or segmented into pseudo words (86) as appropriate. In so doing, the present invention utilizes an abbreviations database (88). Where the particular abbreviation being analyzed corresponds to only one expanded word, that expanded word is immediately conveyed by abbreviations database (88) to look-up control module (90). However, where the particular abbreviation being analyzed corresponds to multiple expanded words, abbreviations database (88) conveys the appropriate expanded word to look-up control module (90) based on analysis by look-up control module (90) of contextual information pertaining to the use of the abbreviation in the input text.

Still referring to FIG. 2, look-up control module (90) is provided in communication with a phrase database (92), word database (94), a new word generator module (96), and a playback rules database (98). After input text (84) is appropriately broken down, expanded and segmented (86), look-up control module (90) first accesses phrase database (92). Phrase database (92) performs forward and backward searches of the input text to locate known phrases. The results of such searches, together with accompanying context information relating to any known phrases located, are relayed to look-up control module (90).

Thereafter, look-up control module (90) may access common words database (94), which searches the remaining input text to locate known words. The results of such searching, together with accompanying context information relating to any known words located, are again relayed to look-up control module (90). In that regard, common words database (94) is also provided in communication with abbreviations database (88) in order to be appropriately updated, as well as with a console (100). Console (100) is provided as a user interface, particularly for defining and/or modifying pronunciations for new words that are entered into common words database (94) or that may be constructed by the present invention and entered into common words database (94), as described below.

Look-up control module (90) may next access new word generator module (96), in order to generate a pronunciation for unknown words, as previously described. In that regard, new word generator module (96) includes new word log (102), a syllable look-up module (104), and a syllable database (106). Look-up module (104) functions to search the input text for sub-words and spellings of syllables for construction of new words or words recognized as containing typographical errors. To do so, look-up module (104) accesses syllable database (106), which includes a collection of numerous possible syllables. Once again, the results of such searching are relayed to look-up control module (90). In addition, in some embodiments of the invention, module (104) functions to search the input text for multi-syllable components (for example, words in word database (94)).

Referring still to FIG. 2, using any results and context information provided by abbreviations database (88), phrase database (92), common words database (94) and/or new word generator module (96), look-up control module (90) performs context analysis of the input speech and accesses playback rules database (98). Using the appropriate rules from playback rules database (98), including rules concerning prosody, pre-distortions and edit points as described herein, and based on the context analysis of the input speech, look-up control module (90) then generates appropriate concatenated voice data (108), which are output as an audible human voice via input/output port interface (82). The voice data (108) may be a continuous voice file, a data stream, or may take any other suitable form including a series of Internet protocol packets.

It is appreciated that the preferred embodiment illustrated in FIGS. 1 and 2 may be implemented in a variety of ways. The digital voice library may include human voice recordings of syllables, words, phrases, and even sentences (not shown). Each item (syllable, word, phrase, or sentence) is recorded in a significant number of voice inflections so that for a particular item, the correct recording may be chosen based on the context around the item in the text input. Further, in a preferred embodiment, the digital voice library includes multiple recordings for an item in a specific inflection. That is, for example, a specific word may have multiple inflections, and some of those inflections may require multiple recordings of the same inflection but having different distortions or ligatures. As such, it is appreciated that the digital voice library is a broad and scalable concept, and may include items, for example, as large as a full sentence or as small as a single syllable or even a phoneme. Further, for any item in the digital voice library, the digital voice library may include multiple recordings of various inflections. And for a particular inflection of a particular item, the library may further include multiple recordings to form different ligatures or distortions as the item meshes with surrounding items.

In addition, it is appreciated that the architecture shown in FIG. 2 may take many forms. For example, although a phrase database, a word database, and syllable database are shown, architecture may be implemented with more databases on either end. For example, there could be a small phrase database, a large phrase database, and even a sentence database. In addition, there could be a syllable database and even a sub-syllable or sound database. The general operation would still follow that outlined above. In addition, it is appreciated that each database may be constructed to interact with the databases above and below it in the hierarchy, for example, as the new word generator module (96) is shown to interact with word database(94).

For example, word database (94) could be implemented to appropriately include a new phrase log, word look-up logic, and a word database, with the word look-up logic being in communication with the phrase database. That is, the architecture in a preferred embodiment is scalable and recursive in nature to allow broad discretion in a particular implementation depending on the application. Further, in the example shown, look-up control module (90) sends text to the intelligent databases, and the databases return pointers to look-up control module (90). The pointers point generally to items in the digital voice library (phrases, words, syllables, etc.). That is, for example, a pointer returned by word database (94) generally points to a word in the digital voice library but does not specify a particular recording (specific inflection, specific distortions, etc.).

Once look-up control module (90) gathers a set of general pointers for the sentence, playback rules database (98) processes the pointer set to refine the pointers into specific pointers. A specific pointer is generated by playback rules database (98). Each specifically points to a particular recording within the digital voice library. That is, module (90) interacts with the databases to generally construct the sentence as a sequence of general pointers (a general pointer points to an item in the library), and then playback rules database (98) cooperates with look-up control module (90) to specifically choose a particular recording of each item to provide for proper inflections, distortions, and ligatures in the voice output. Thereafter, the sequence of specific pointers (a specific pointer points to a specific recording of an item in the library) is used to construct the voice data at (98), which is sent to output interface (82). Construction of the voice data may include manipulation of playback switch points.

The present invention can thus "capture" the dialects and accents of any language and match the general item pointers returned by the databases with appropriate specific pointers in accordance with playback rules (98). The present invention analyzes text input and assembles and generates speech output via a library by determining which groups of words have stored phrase recordings, which words have stored complete word recordings, and which words can be assembled from multiple syllable recordings and, for unknown words, pronouncing the words via syllable recordings that map to the incoming spellings. The present invention can either map known common typographical errors to the correct word or can simply pronounce the words as spelled primarily via syllable recordings and phoneme recordings if needed.

The present invention also calculates which inflection (and preferably, some words or items may have multiple recordings at the same inflection but with different distortions) would sound best for each recording that is played back in sequence to form speech. A console may be provided to manually correct or modify how and which recordings are played back including speed, prosody algorithms, syllable construction of words, and the like. The present invention also adjusts pronunciation of words and abbreviations according to the context in which the words or abbreviations were used.

Figure 3:
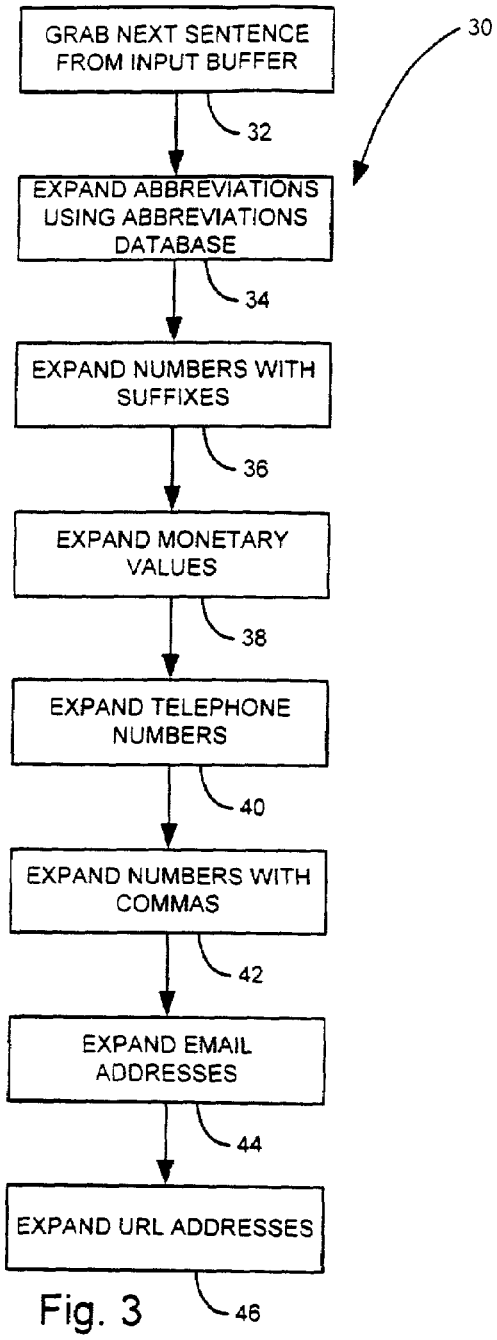
FIG. 3 is a block diagram illustrating text breakdown.
Figure 5:
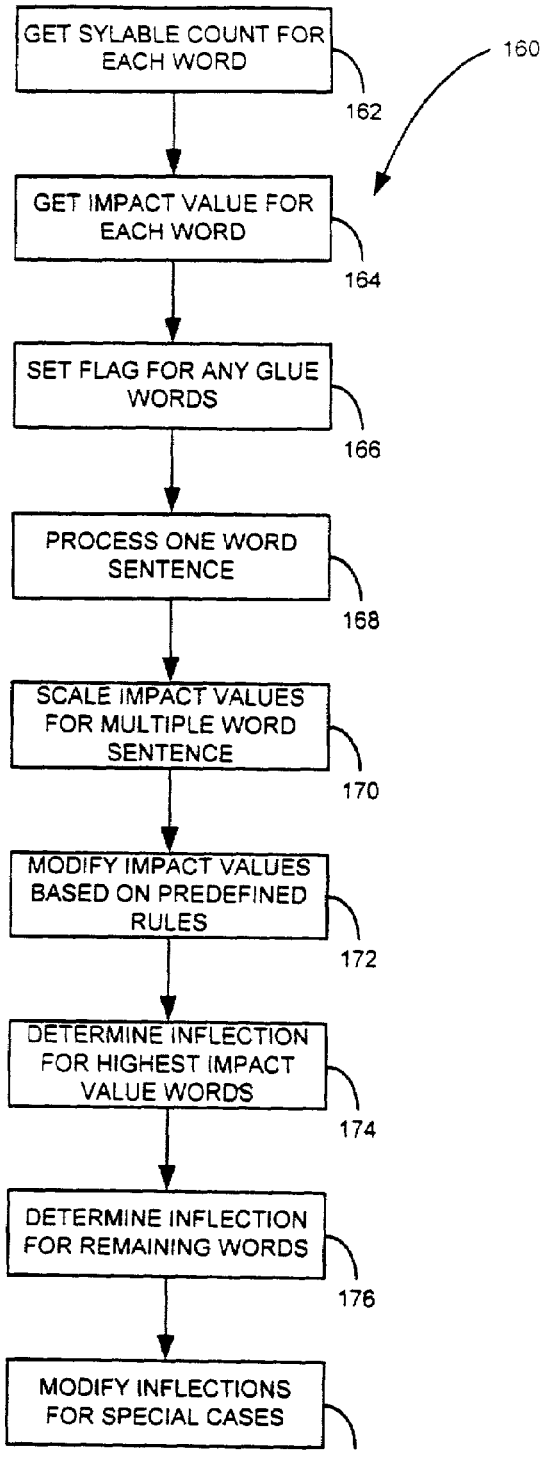
FIG. 5 is a block diagram illustrating inflection selection in accordance with playback rules and with the diagrams in FIGS. 4A-C.
Figure 4A:
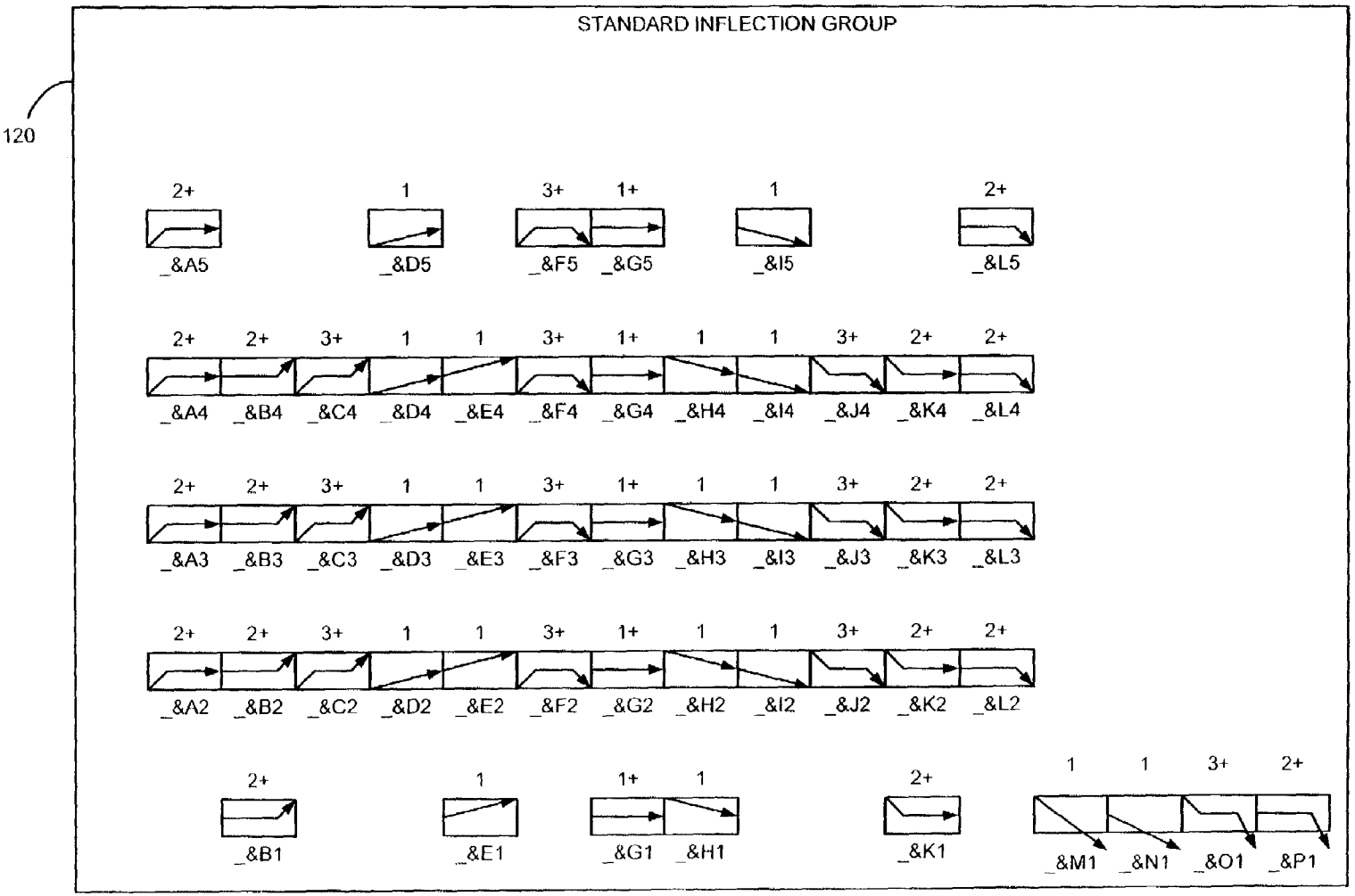
FIGS. 4A-C are inflection mapping diagrams associated with a digital voice library.
Figure 4B:
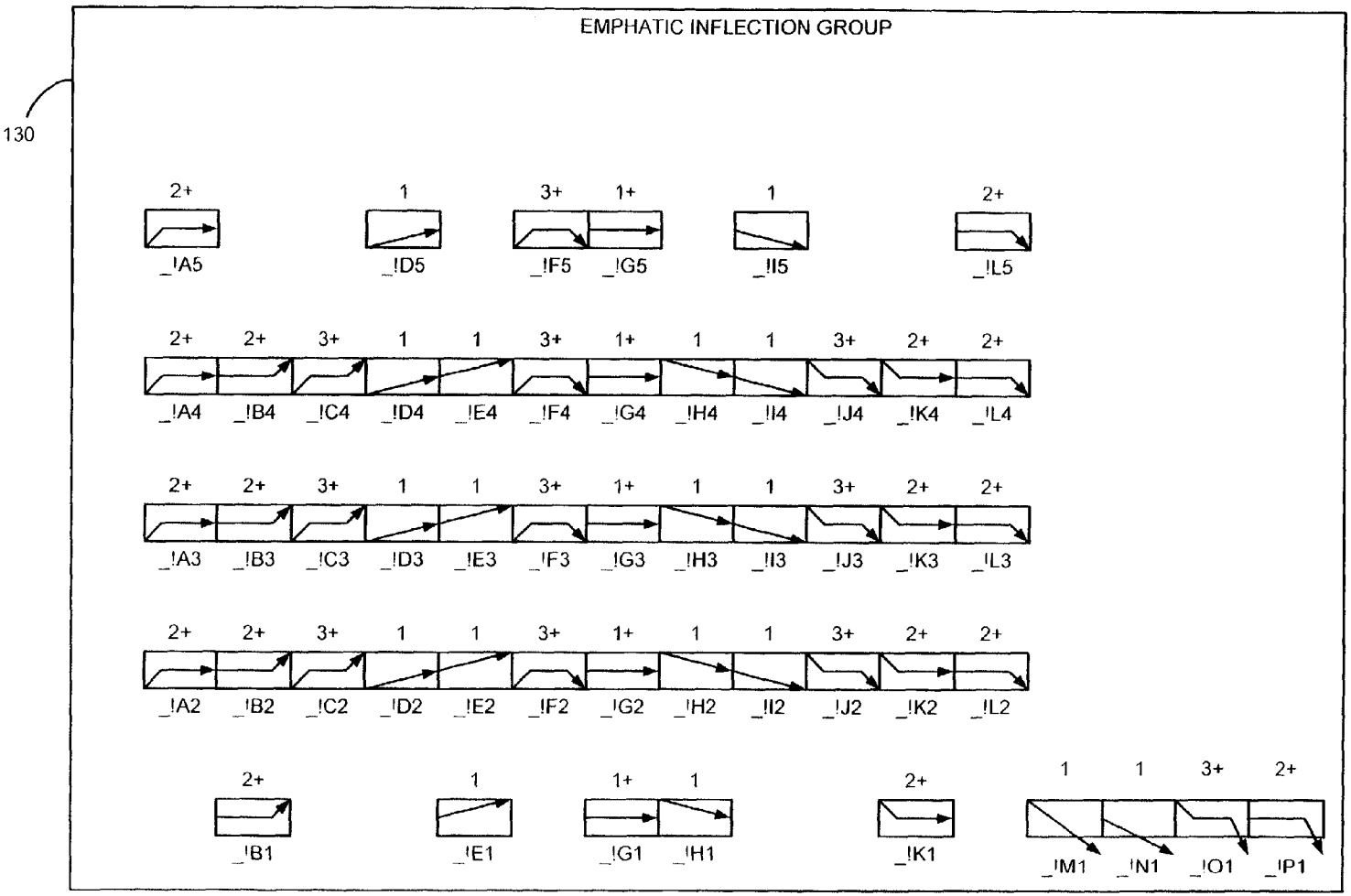
Figure 4C:
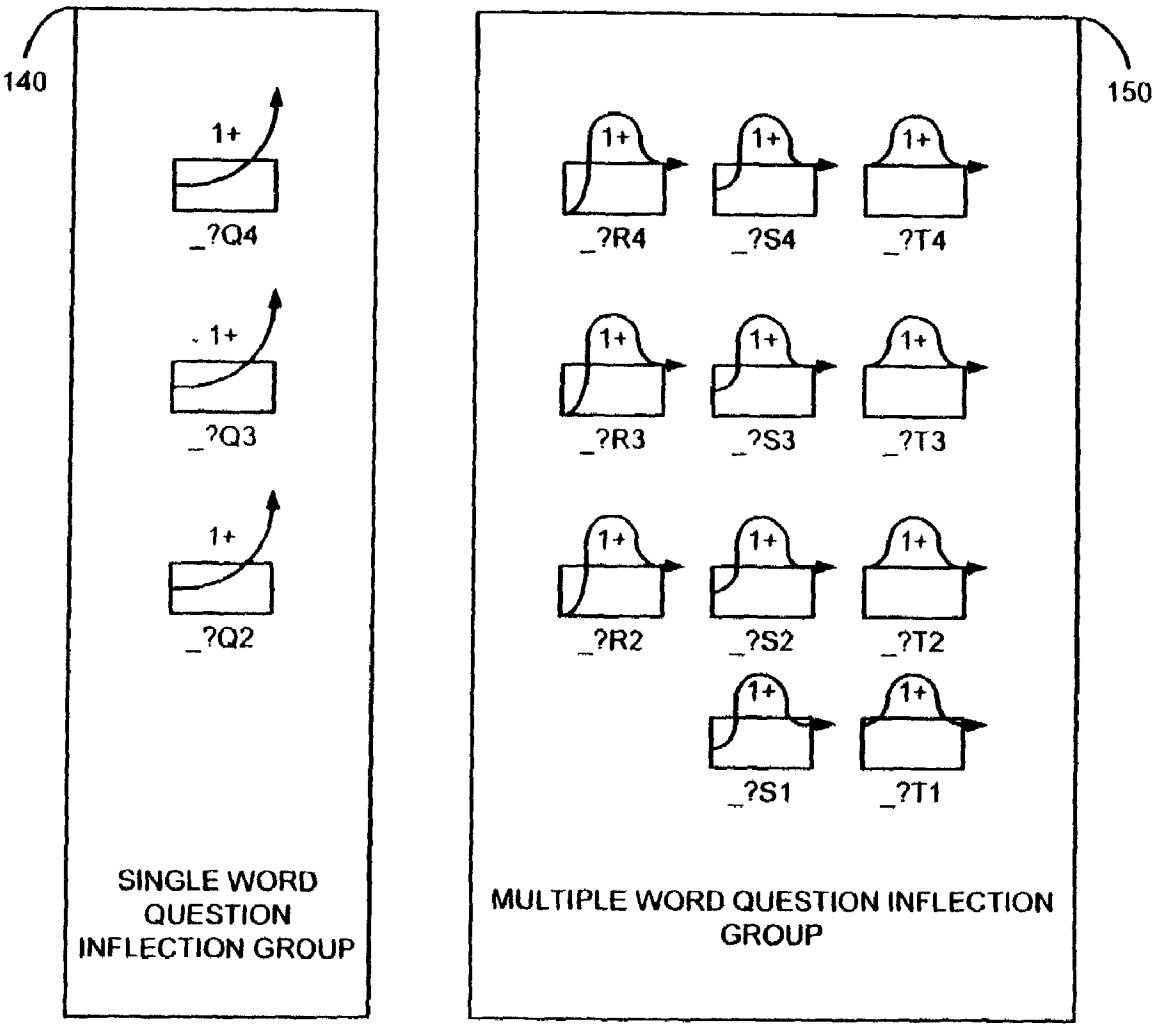

FIG. 3 illustrates a suitable text breakdown technique at 30 and FIGS. 4A-C illustrate a suitable inflection mapping table including groups 120, 130, 140, and 150. That is, each item in the digital voice library may be recorded in up to as many inflections as present in the inflection table. Further, there may be a number of recordings for each inflection. FIG. 5 broadly illustrates the selection of appropriate inflections for each word or item in a sentence in a suitable implementation at 160. Below, FIGS. 3-5 are described in detail, but of course, other implementations are possible and FIGS. 3-5 merely describe a suitable implementation. Further, as mentioned previously, the architecture of FIG. 2 is scalable to handle items of various size, and similarly, the mapping table of FIG. 4 is suitable for words, but similar approaches may be taken to map larger items such as phrases or smaller items such as syllables.

Inflection and pitch changes that take place during a spoken sentence are based upon the syllable structure of the target sentence, not upon the word structure of the target sentence. Furthermore, inflection and pitch changes are dependent not only on the syllable structure of the target word, but also on the syllable structure of the surrounding words. Each sentence can normally be treated as a stand-alone unit. In other words, it is generally safe to choreograph the inflection/pitch changes for any given sentence without having concern for what nearby sentences might contain. Below, an exemplary text breakdown technique is described.

EXAMPLE

Pseudo-Code Breakdown (FIG. 3)

Step #A1

Grab the next sentence from the input buffer (block 32). A sentence can be considered to have terminated when any of the following are read in.

A Colon.

This is only considered as a sentence terminator if the byte that follows the colon is a space character, a tab character or a carriage return.

A Period.

This is only considered as a sentence terminator if the byte that follows the period is a space character, a tab character or a carriage return.

Exception: note that if it is determined that the word preceding the period is an abbreviation, then this period will not be considered as a sentence terminator (exception to the exception: unless the period is followed by one or more tab characters, three or more space characters and/or two or more carriage returns in which case the period following the abbreviation is considered a sentence terminator).

An Exclamation Point or Question Mark.

This is only considered as a sentence terminator if the byte that follows the exclamation point or question mark is a space character, a tab character or a carriage return.

One or More Consecutive Tab Characters.

Three or More Consecutive Space Characters.

Two or More Consecutive Carriage Return Characters.

Of course, this list of sentence terminators is an example, and a different technique may be used in the alternative.

Step #A2

Search the sentence for abbreviations (block 34). Among the many other abbreviation categories that should be made a part of this process, this search should probably include the United States Postal Service abbreviation list. Many abbreviations will conclude with a period, but some will not. The Postal Service, for example, asks that periods not be used as part of an address—even if the word in question is an abbreviation—so the use of a period at the conclusion of an abbreviation should necessarily be one of several search criteria. Once abbreviations are identified, they can be converted into their full word equivalents.

Step #A3

Search the sentence for digits that end with "ST", "ND", "RD" and "TH" (block 36). Convert the associated number into instructions for speaking. For example, "$44^{th}$" will be spoken as "forty-fourth." And "$600^{th}$" will be spoken as "six hundredth."

Step #A4

Search the sentence for monetary values (block 38). In the United States, this is indicated by a dollar sign ("$") followed directly by one or more numbers. Sometimes this will extend to include a period (decimal point) and two more digits representing the decimal part of a dollar. This can then be converted into the instructions that will generate a spoken dollar (and cents) amount.

Step #A5

Search the sentence for telephone numbers (block 40). In the United States, this will commonly be indicated in one of ten ways: 555-5555, 555 5555, (000) 555-5555, (000) 555 5555, 000-555-5555, 000 555 5555, 1 (000) 555-5555, 1 (000) 555 5555, 1-000-555-5555, 1 000 555 5555.

Of course, there are telephone numbers that don't fit into one of the above ten templates, but this pattern should cover the majority of telephone number situations. Pinning down the existence and location of a phone number in most applications will probably revolve around first searching for the typical <three digit> <separator> <fourdigit> pattern common to all United States phone numbers.

Step #A6

Search the sentence for numbers that contain one or more commas (block 42). Many times if a writer wishes his/her number to represent "how many" of something, he/she will place a comma within the number. The parsing routines can use this information to flag that the number should be read out in expanded form. In other words, 24,692,901 would be read out as "twenty four million, six hundred ninety two thousand, nine hundred one." Other numbers may be read out one digit at a time, as many numbers are expected to be heard (for example, account numbers).

Step #A7

Search the sentence for internet mail addresses (block 44). These will contain the at symbol ("@") somewhere within a consecutive group of characters. There are a limited number of different characters that can be made a part of an email address. Therefore, any byte that is not a legal address character (such as a space character) can be used to locate the beginning and end of the address. The period is pronounced as "dot."

Step #A8

Search the sentence for Internet Universal Resource Locator (URL) addresses (block 46). Unlike email addresses, these will be a bit more difficult to pin down.

Oftentimes they contain "www." but not always. Sometimes they begin with "http://" or "ftp://" but not always. Sometimes they end with ".com" ".net" or ".org" but not always (especially when including international addresses). A suitable implementation obtains the current list of all acceptable URL suffixes, and searches each group of consecutive characters in the target sentence to see if any of these groups end with one of the valid suffixes. In most cases where a valid suffix is found (".com" for example) it is probably safe to assume that if the byte immediately preceding the period is acceptable for use in a URL address, that the search routine has actually located part of a valid URL.

Also note that many URLs are listed in some form of their 32-bit address. It is also common for these numerical URL addresses to contain additional information designed to fine tune the target location of the URL. The location of a period in a URL address is spoken aloud and it is pronounced "dot."

Step #A9

If words are discovered that are not a part of the words library, then a syllable based re-creation of the word will have to be generated as explained elsewhere herein.

Of course, it is appreciated that the example text breakdown steps given herein do not limit the invention and many modifications may be made to arrive at other suitable text breakdown techniques. Below, an exemplary inflection selection technique is described.

EXAMPLE

Inflection Selection (FIG. 5)

Step #B1

Each and every word in the target sentence is analyzed to obtain three chunks of information (blocks 162, 164, and 166 of FIG. 5).

Figure 23:
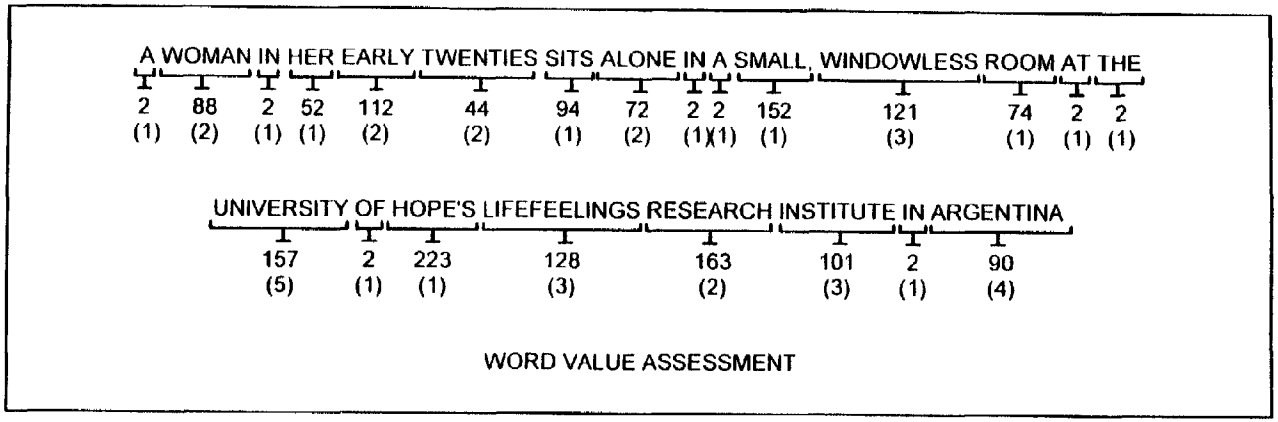
FIG. 23 depicts word value assessment during inflection selection in accordance with playback rules and shows impact values and syllable counts.

First, the syllable count of each word in the target sentence is obtained (block 162). In FIG. 23 this syllable count is displayed in parenthesis below each word. In a suitable implementation, syllable count for each word is determined as the list of to be recorded words is created.

Second, the impact value of each word in the target sentence is obtained (block 164). In FIG. 23 the value that has been assigned to each word is displayed just above the syllable count. The impact value for each word may be determined as the list of to be recorded words is created.

Determining the impact value (from zero up through two hundred fifty-five in the example) for each word will be a complex process. In short, the more descriptive and/or important a word is, the higher will be its assigned impact value. These values will be used to determine where in a spoken sentence the inflection changes will take place. The overall objective of this impact value concept is to ensure that each spoken sentence will have its own unique pattern of natural sounding inflections, without any need to reference those sentences that precede and follow the current sentence.

As impact values and syllable counts are obtained while parsing a sentence during this step, many words will be discovered that do not exist in the current words library. This means that in addition to having to generate a syllable based representation of an unknown word, an impact value and syllable count number must also be created for the newly generated word. Because a valid impact value runs from zero (0) at the low end to two hundred fifty-five (255) at the upper end, the impact value for an unknown word can be set to any number in this range, possibly based on the number of syllables.

For example, an unknown single syllable word might be given an impact value of one hundred eight (108). An unknown two syllable word might be given an impact value of one hundred eighteen (118). An unknown three syllable word might be given an impact value of one hundred twenty-eight (128). An unknown four syllable word might be given an impact value of one hundred thirty-eight (138).

Third, each word must have a flag set (block 166) if its purpose is not normally to carry information but rather to serve the needs of a sentence's structure. Words that serve the needs of a sentence's structure are called glue words or connective words. For example, "a," "at," "the" and "of" are all examples of glue or connective words. When the software must determine which audio samples to use to voice the current sentence, the inflection/pitch values for words flagged as glue words can freely be adjusted to meet the needs of the surrounding payload words. Of course, it is appreciated that this step and the remaining steps in the inflection selection example given herein do not limit the invention and many modifications may be made to arrive at other suitable inflection mapping techniques. Further, the inflection maps of FIGS. 4A-C and method of FIG. 5 illustrate the mapping of words from word database 94 to specific word inflections. However, similar techniques may be utilized for mapping phrases, syllables, or other items in accordance with the scalable architecture of embodiments of the present invention. A more detailed description of glue words is given later herein.

Step #B2

If the target sentence is only one word in length, then the method the original writer chose to use when writing the one word sentence will determine how the sentence is spoken (block 168). In the remaining Step #Bx steps, inflections are selected for each word from the tables of FIGS. 4A-C. It is appreciated that some words may be recorded in each and every inflection, while others are recorded in a limited number of inflections (the closest match would then be chosen.) Further, some embodiments may have several records for a single inflection, with a different distortion for each record.

For example, if the one word sentence ends with an exclamation point, then a digitized word from the "Emphatic Inflection Group" (130, FIG. 4B) will be spoken. If the word contains only one syllable, then "_!H3" should be used. On the other hand, if the word contains more than one syllable, then "_!L3" should be used.

If the one word sentence ends with a question mark, then a digitized word from either the "Single Word Question Inflection Group" (140, FIG. 4C) or the "Multiple Word Question Inflection Group" (150, FIG. 4C) will be spoken. If the one word question is anything except "why" then "_?Q3" should be used. On the other hand, if the word is "why," then "_?S3" should be used.

If the one word sentence ends with anything else (including a period), then a digitized word from the "Standard Inflection Group" (120, FIG. 4A) will be spoken. If the word contains only one syllable, then "_&H3 " should be used. On the other hand, if the word contains more than one syllable, then "_&L3" should be used.

Step #B3

For the remainder of this breakdown, the following example sentence will be used: "A women in her early twenties sits alone in a small, windowless room at the University of Hope's LifeFeelings Research Institute in Argentina." (FIG. 23) Please note that the impact values assigned to the words in FIG. 23 are only examples (as the sentence is also but an example).

Because each sentence should stand on its own, the sentence is normalized (block 170). Normalizing is accomplished as follows:

1) Evaluate the current sentence to discover the word (or words, if there is a tie between two or more words) with the largest impact value. In this example, the word with the largest impact value is "Hope's" with a value of two hundred twenty-three (223).
2) Divide the largest impact value by four (4). In this example, the result would be fifty-five and seventy-five hundredths (55.75).
3) Work through the entire current sentence a word at a time and perform this calculation: divide the impact value of the current word by the value that was obtained at Step #2. For example, if the word in question is "windowless" (which in our example has been assigned an impact value of one hundred twenty-one (121), then the formula is "121/55.75 =2.17"
4) This number is then rounded up or down to the closest integer value, and then it is incremented by one (1). This will leave an integer ranging from one (1) up through five (5). This final integer is loosely associated with the five inflection/pitches of FIGS. 4A-C.

Figure 24:
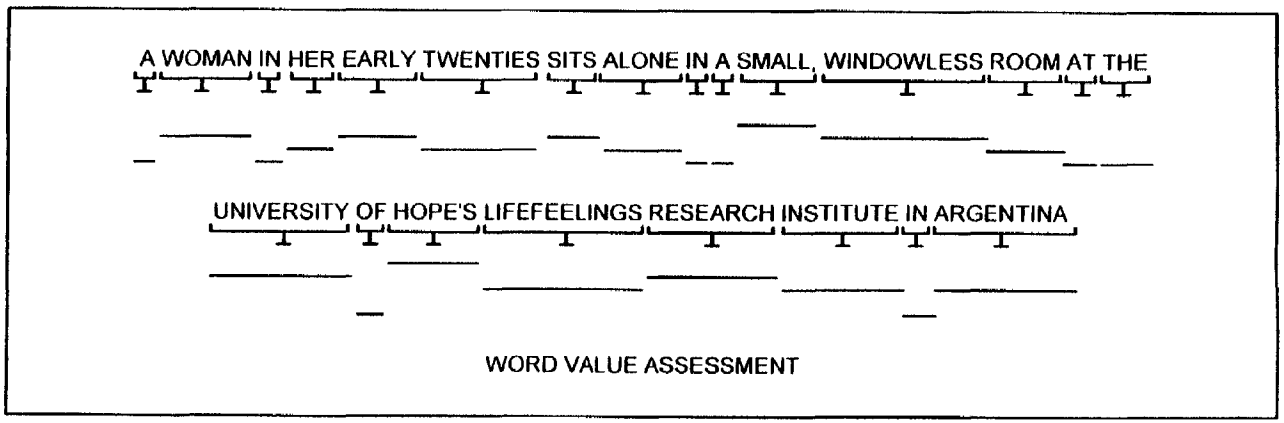
FIG. 24 depicts word value assessment during inflection selection in accordance with playback rules and shows initial pitch/inflection values.

FIG. 24 gives a good idea of where each word's inflection/pitch will fall after this part of the process has been performed.

Step #B4

At this point things become somewhat more complex (block 172). A target sentence can sound odd if within the sentence, three or more consecutive words have the same inflection/pitch value. As an exception to this, however, three consecutive words can sound just fine if the inflection/pitch value in question is a one (1) or a two (2). Another exception is that in some situations as many as three or four consecutive (inflection/pitch one [1], two [2] and three [3]) words can sound acceptable if they lead the sentence.

Furthermore, there should be at least two or three words between any two words that have an inflection/pitch value of five (5). There should also be at least one or two words between any two words that have an inflection/pitch value of four (4).

This is where the original impact values assigned to each word can again become useful. Because Step #B3 causes a kind of loss of resolution regarding the impact values, these original values can be helpful when trying to jam an inflection/pitch wedge between two words.

In order to make certain that these rules are not broken, it will oftentimes become necessary to remodulate a sentence using the original impact values as a guide. If a word's inflection/pitch value must be changed, it will usually require that changes be made not just to a single word but to some of the words that surround it. It may even at times become necessary to remodulate the inflection/pitch values for an entire sentence. When the inflection/pitch value is temporarily changed for a sentence (not in the digital voice library), the impact value should also be temporarily changed. The example sentence does not break any of the rules of this step so no adjustments would have been made.

Step #B5

It is usually not a good idea to start a sentence with an inflection/pitch value lower than three (block 172). As such, in the example sentence the leading "A" is re-configured to an inflection/pitch value of three (3).

Again, when changes are made to the inflection/pitch values associated with a word, new (temporary) impact values, that fall within range for the new inflection/pitch number, are generated and stored.

Step #B6

Within the target sentence it will usually not be a good idea if any word that is just prior to (as in attached to) a comma or a semi-colon has an inflection/pitch value greater than three (3) (block 172). Also, if the sentence ends with a period or an exclamation point the last word in the sentence should probably have an inflection/pitch value of one (1) (block 172).

Again, when changes are made to the inflection/pitch values associated with a word, new (temporary) impact values, that fall within range for the new inflection/pitch number, are generated and stored. Of course, Steps #B5-B6 may have any number of exceptions. In the example sentence, the word "small" is attached to a comma, but due to the context, the inflection/pitch value remains unchanged.

Step #B7

This part of the process takes a bit of a top down approach. The method starts working on the words with the highest inflection/pitch values (block 174), and works its way down to the lowest value words. As each specific sample is finally decided upon it is important that the choice be stored so that it can be referenced. This applies not only to the inflection/pitch five (5) words, but to all of the text in the current sentence. Of course once the speech instructions for the current sentence are complete, this information can be disposed.

Note that in this section of exemplary rules the word "valid" applies to any word which is not a glue word. For example, "a," "at," "the" and "of" are all examples of glue words. The inflection mapping of the words having an inflection/pitch value of five (5) is as follows.

Locate the first inflection/pitch five (5) word in the target sentence. If the selected word is a one (1) syllable word, then either the "_&D5" or the "_&I5" sample should be used. To determine which of the two should be used, evaluate the words on either side of the current word (if the nearest word is flagged as a glue word, ignore it and move on to the next non-glue word). Ignore the current value of the word to the left and/or to the right of the current word if it is on the other side of a comma or a semi-colon.

If the valid word that precedes the target word has a larger impact value than the valid word that follows the target word, then use the "_&I5" sample. If the valid word that precedes the target word has a smaller impact value than the valid word that follows the target word, then use the "_&D5" sample.

If the valid words on either side have the same impact value then consider how many glue words had to be ignored before coming across a valid word. If the part of the sentence preceding the target word has the larger number of glue words, then use the "_&D5" sample. If the part of the sentence preceding the target word has the smaller number of glue words, then use the "_&I5" sample.

If this still does not solve the problem, then just randomly select one of the two samples. It is important, however, that if forced to randomly select any sample for playback, make certain to remodulate the rest of the sentence so that it sounds natural.

If the selected word is a two (2) syllable word, then either the "_&A5" or the "_&L5" sample should be used. To determine which should be used, evaluate the words on either side of the current word (if the nearest word is flagged as a glue word, ignore it and move on to the next non-glue word).

If the valid word that precedes the target word has a larger impact value than the valid word that follows the target word, then use the "_&L5" sample. If the valid word that precedes the target word has a smaller impact value than the valid word that follows the target word, then use the "_&A5" sample.

If the valid words on either side have the same impact value then consider how many glue words had to be ignored before coming across a valid word. If the part of the sentence preceding the target word has the larger number of glue words, then use the "_&A5"sample. If the part of the sentence preceding the target word has the smaller number of glue words, then use the "_&L5" sample.

If this still does not solve the problem, then just randomly select one of the two samples. It is important, however, that if forced to randomly select any sample for playback, make certain to remodulate the rest of the sentence so that it sounds natural.

If the selected word is a three (3) or more syllable word, then either the "_&A5", the "_&F5" or the "_&L5" sample should be used. To determine which should be used, evaluate the words on either side of the current word (if the nearest word is flagged as a glue word, ignore it and move on to the next non-glue word).

If the valid word that precedes the target word has a larger impact value than the valid word that follows the target word, then use the "_&L5" sample. If the valid word that precedes the target word has a smaller impact value than the valid word that follows the target word, then use the "_&A5" sample. If the valid words on either side have the same impact value then use the "_&F5" sample. Move on to the next inflection/pitch five (5) word in the current sentence (if one exists) and repeat this step (step #B7).

Step #B8

This step (step #B8) is essentially repeated for all of the remaining text. A suitable implementation starts with those words flagged as inflection/pitch four (4), then moves on to three (3), then two (2) and finally one (1) (block 176). The inflection mapping of the remaining words is as follows.

Locate the first inflection/pitch four (4) word in the target sentence (or the first inflection/pitch three [3] word in the target sentence after all of the four [4] words, or the first inflection/pitch two [2] word in the target sentence all of the three [3] words, or the first inflection/pitch one [1] word in the target sentence after all of the two [2] words).

Ignore the current value of the word to the left and/or to the right of the current word if it is on the other side of a comma or a semi-colon. If the word that precedes the current word has already been defined but the word following the target word has not yet been defined, then select a voice sample (from FIGS. 4A-C) that is designed to mesh with the word that precedes the current word. If the word that precedes the current word has not already been defined but the word following the target word has been defined, then select a voice sample (from FIGS. 4A-C) that is designed to mesh with the word that follows the current word. If both words have already been defined then select a voice sample, (from FIGS. 4A-C) that will act as a bridge between the two.

Figure 25:
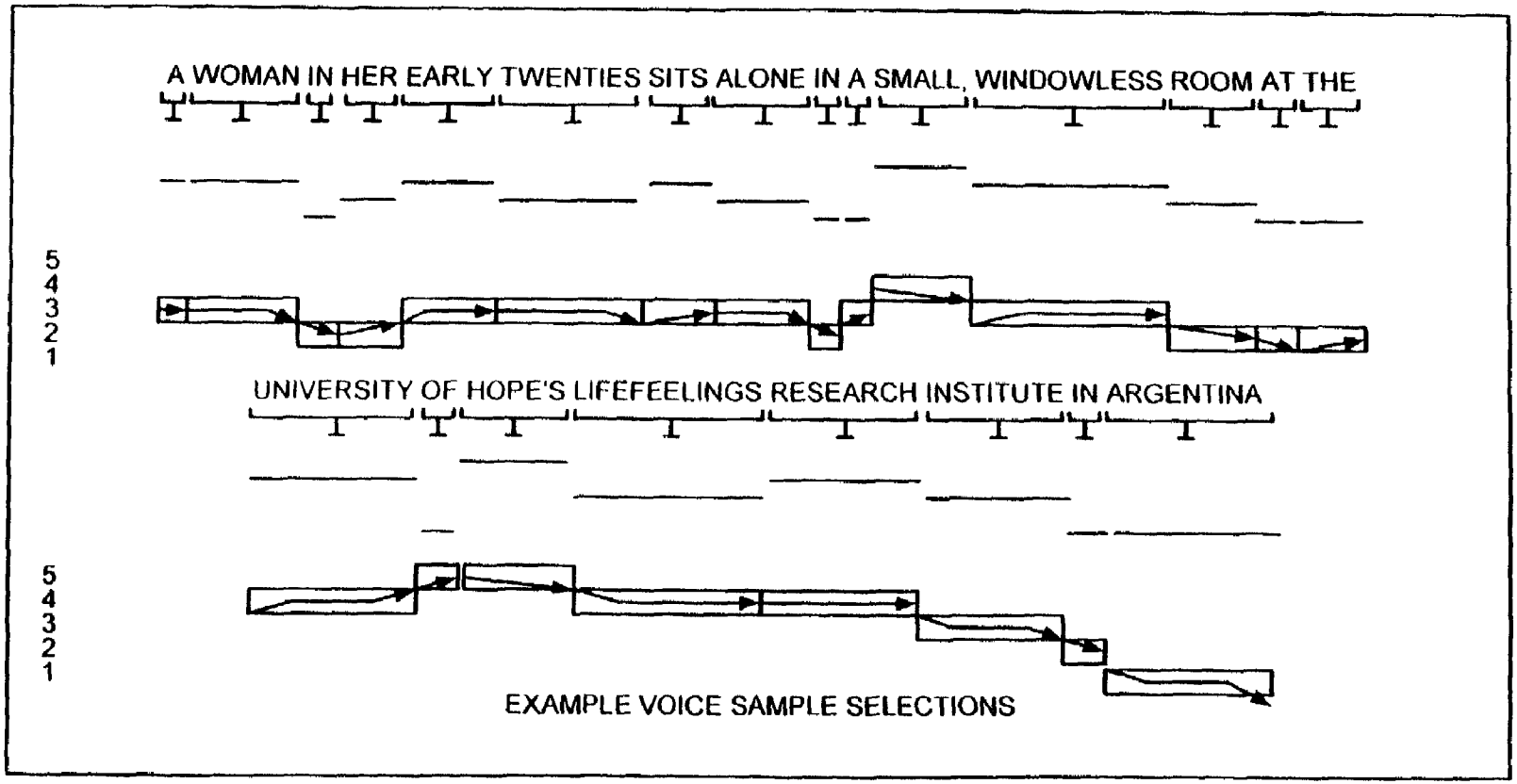
FIG. 25 depicts example voice sample selections during inflection selection in accordance with the playback rules.

If neither the word preceding nor the word following the current word have yet been defined, then start a new pattern following basically the same rules as when determining which samples to select for the inflection/pitch five (5) words. When the program has finished with this part of the task, the voice sample selections it made might look a little like those displayed in FIG. 25.

Step #B9

In a suitable embodiment, when a word directly precedes a comma or a semi-colon, a tiny bit of a pitch drop and a pause will likely be required. As such, whichever sample has been selected, make certain to instead use its closest relative that possesses a slight pitch down at the end of the word (block 178).

Step #B10

The "_&M1", "_&N1", "_&O1" and "_&P1" group of samples is specifically designed to conclude a sentence. These specific samples will be recorded with a soft pitch down at the conclusion of the word (block 178).

Step #B11

If the target sentence terminates with an exclamation point, the construction of the output information can take place as already described, but instead of using the "_&Xn" samples, use the "_!Xn" samples (block 178).

Step #B12

If a sentence terminates with a question mark and it is longer than a single word, construct the sentence as if it terminated with an exclamation point (using the "Emphatic Inflection Group"), and add the sentence's final word from the "Multi Word Question Inflection Group."(Block 178.)

It is appreciated that text breakdown in accordance with the #Ax steps and inflection mapping in accordance with the #Bx steps are merely examples of the present invention. That is, alternative rules may dictate text breakdown, and other approaches may be taken for inflection mapping. Further, the inflection mapping of the #Bx steps is for words, but because the present invention comprehends scalable architecture, inflection mapping may be performed for other elements such as syllables or phrases or others.

Although the general architecture of the present invention along with exemplary techniques for text breakdown and inflection mapping have been described, many additional features of the invention have been mentioned. Of the additional features, several are explained in further detail below for use in preferred implementations of the invention. Immediately below, use of the syllable database to convert unknown words (words not in the word library) is described. It is appreciated that the pronouncing of unknown words may involve inflection mapping similar to FIGS. 4A-C but at the syllable level. That is, the unknown word is made up of syllables similar to the way that a sentence is made up of words, and syllable inflection mapping is used for each syllable.

Figures 6, 7:
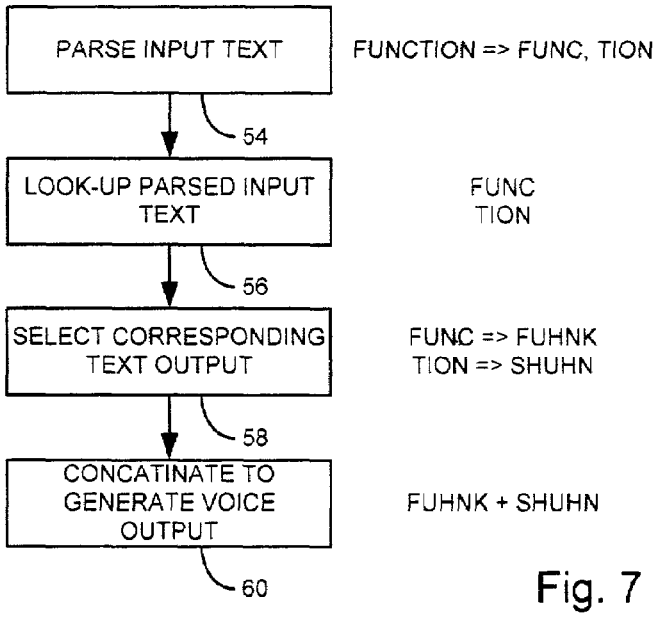
FIG. 6 illustrates conversion of text as known words or literally spelled by syllable to spoken output as pre-recorded words or phonetically spelled by syllable.
FIG. 7 broadly illustrates the conversion from input text to concatenated voice output.

The system and method of the present invention can also attempt to pronounce unknown words by using the most frequently used spellings of syllables. More specifically, referring now to FIGS. 6 and 7, exemplary tables are shown for text-to-voice conversion according to the system and method of the present invention which depict syllable-level conversion of text as known words or literally spelled by syllable to spoken output a pre-recorded words or phonetically spelled by syllable. As seen in FIG. 6, the input layer is words broken down into known words (within quotation marks) or syllables (50) and the output layer is pre-recorded words (within quotation marks) or the phonetic spelling of the syllables (52). The spelling of several hundred thousand words at the syllable breakdown level is used as an input. The results of the most commonly used mapping of literal spellings to phonetic pronunciations of syllables can then be used as the lookup criteria to select recordings of syllables for a syllable level concatenated speech output. Each syllable may be recorded in multiple inflections and each inflection recorded in multiple ligatures. In addition to syllable look-up techniques (shown in the "action" and "function" examples), words contained wholly within the unknown word (that is, sub-words) may be determined for parts of the unknown word. An example of a word that contains a known sub-word is shown in the right most column ("compounding").

With reference to the example of FIG. 7, text input is first parsed (54) via forward and backward searches of the text. The present invention first searches the text input forward for the smallest text segments that are recognized and can stand alone as words. If no such segments are found, the text input is searched forward for text segments that are recognized as syllables. The text input is then searched backward for the smallest text segments that are recognized and can stand alone as words. If no such segments are found, the text input is searched backward for text segments that are recognized as syllables. The words and syllables located as a result of these searches are ranked based on character size, with the largest resulting words and syllables chosen for use in generating concatenated voice output. In that regard, the resulting words and syllables of the parsed text are looked-up (56) in the digital voice library, and the voice recordings corresponding to those words and syllables selected (58) for concatenation (60) in order to generate the appropriate voice output corresponding to the original text input, in a fashion similar to processing the words of a sentence. Again, an inflection mapping technique may be employed where some syllables are recorded in multiple inflections. Lastly, in a preferred embodiment, after an unknown word is processed, the results are stored so that a next encounter with the same unknown word may be handled more efficiently.

In that regard, the system is trained with real language input data and its relation to phonetic output data at the syllable level to enable a system to make a best guess at the pronunciation of unknown words according to most common knowledge. That is, the literal spellings of syllables are mapped to their actual phonetic equivalent for pronunciation. Utilizing this data, the system and method of the present invention generate voice output of unknown words, which are defined as words that have not been either previously recorded and stored in the system, or previously concatenated and stored in the system using this unknown word recognition technique or using the console, or a typographical error that was unintentional. The mapping can be performed by either personnel trained in this type of entry or a neural network can be used that memorizes the conditions of spoken phonetic sequences related to spelling of the syllables.

In addition to the recognition of unknown words in accordance with the scalable architecture of FIG. 2 and the techniques of FIGS. 6-7, embodiments of the present invention provide for smooth transition between adjacent voice recordings. Although some smooth playback is achieved through selecting recordings with appropriate inflection and ligatures, switch point manipulation provides even smoother output in preferred embodiments.

The present invention manipulates (in preferred implementations) the playback switch points of the beginnings and endings of adjacent recordings in a sentence used to generate concatenated voice output in order to produce more natural sounding speech. In that regard, the present invention categorizes the beginnings and endings of each recording used in a concatenated speed application such that the switch points from the end of one recording and the beginning of the next recording can be manipulated for optimal playback output. This is an addendum to the inflection selection and unknown word processing.

Figure 8:
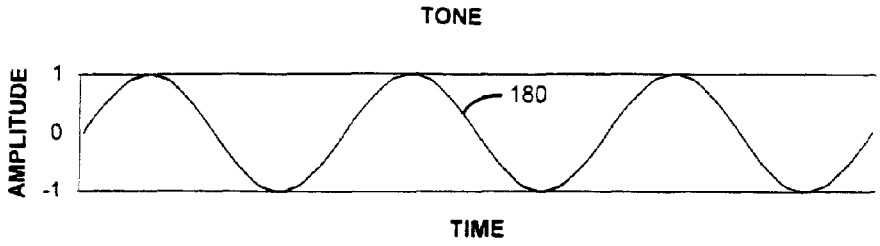
FIG. 8 graphically represents a tone sound.
Figure 9:
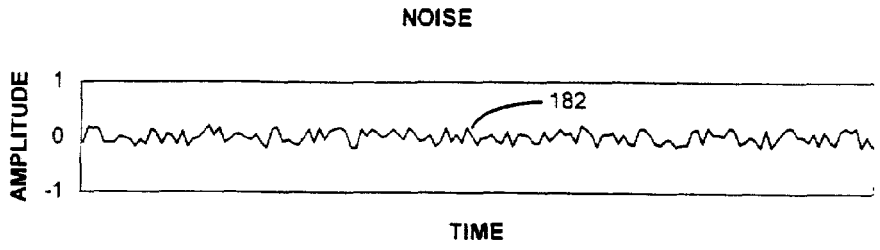
FIG. 9 graphically represents a noise sound.
Figure 10:
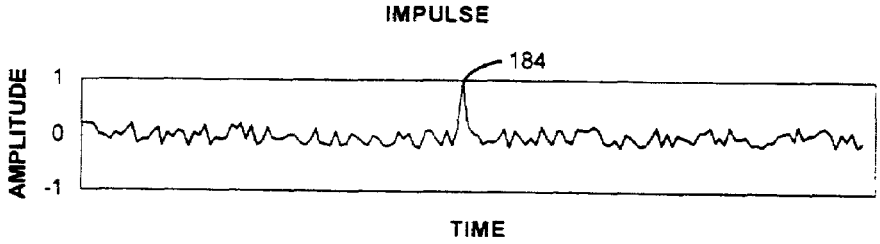
FIG. 10 graphically represents an impulse sound.
Figure 11:
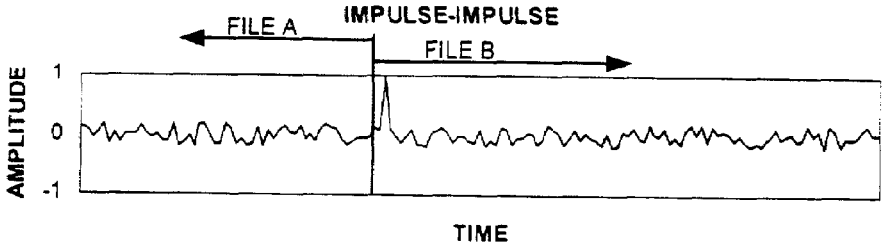
FIG. 11 graphically represents concatenation of an impulse and an impulse.
Figure 12:
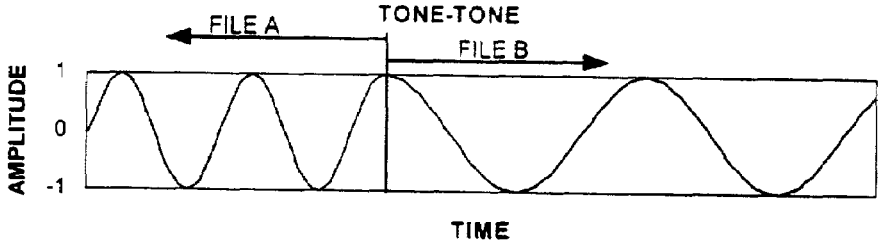
FIG. 12 graphically represents concatenation of a tone and a tone.

More specifically, according to the present invention, the sonic features at the beginnings and endings of each recording used in a concatenated speech system are classified as belonging to one of the following categories: tone (T); noise (N); or impulse (I). FIGS. 8-10 are graphic representations of exemplary tone (180), noise (182) and impulse (184) sounds, respectively. As seen therein, the impulse sound (184) is the result of the pronunciation of the letter "T", while the tone and noise sounds (180 and 182) are the result of the pronunciations of the letters "M" and "S", respectively. Of course, these three sounds or sonic features are shown to illustrate switch point manipulation and it is appreciated that additional sonic features may be used. For example, in a very complex implementation, all sonic beginnings and endings may be manipulated.

Based on these classifications, the present invention dictates the dynamic switching scheme set forth below. In the following (FIGS. 11-22), the first "x" is the end of one recording and the abutting "x" is the beginning of the next recording.

Figure 13:
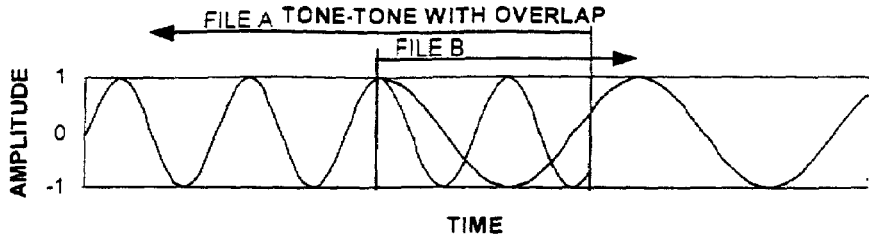
FIG. 13 graphically represents concatenation of a tone and a tone with overlap.
Figure 14:
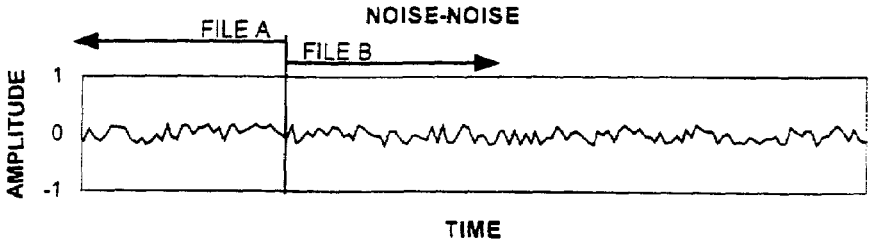
FIG. 14 graphically represents concatenation of noise and noise.
Figure 15:
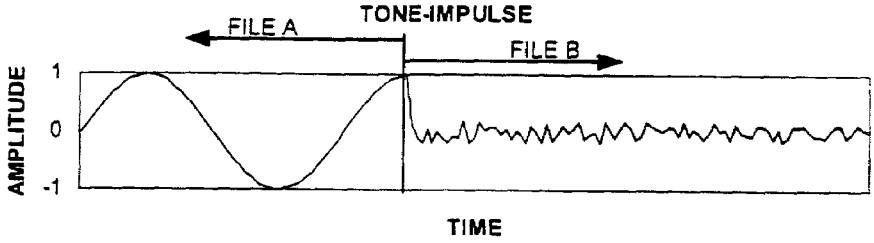
FIG. 15 graphically represents concatenation of a tone and an impulse.
Figure 16:
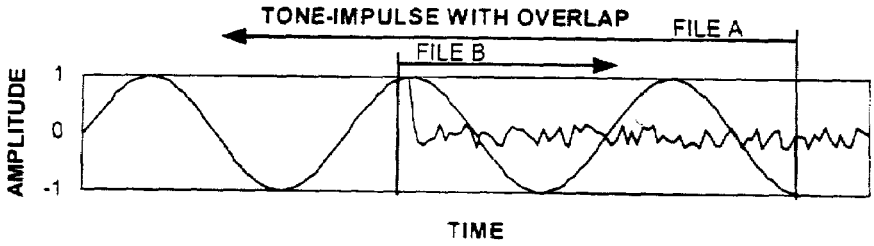
FIG. 16 graphically represents concatenation of a tone and an impulse with overlap.
Figure 17:
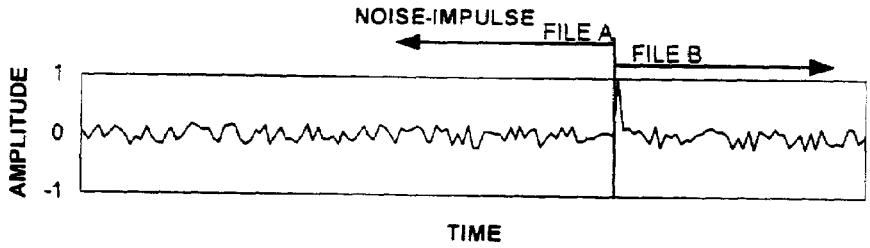
FIG. 17 graphically represents concatenation of noise and an impulse.
Figure 18:
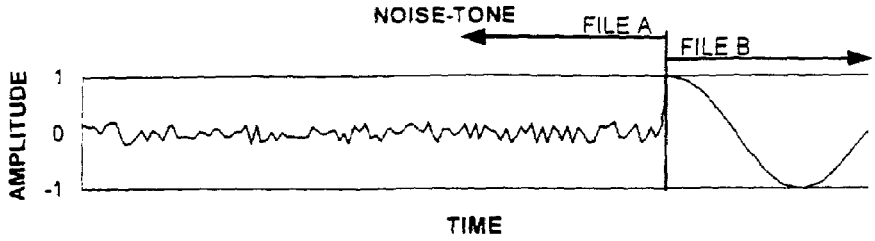
FIG. 18 graphically represents concatenation of noise and a tone.
Figure 19:
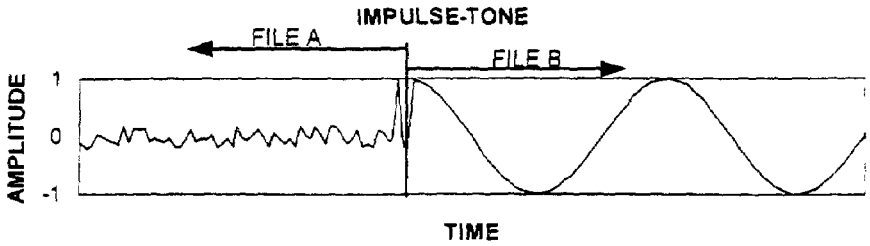
FIG. 19 graphically represents concatenation of an impulse and a tone.

- "I" abutting "I" (FIG. 11): synchronize the impulses; switch to, and only playback the impulse and remainder of the second recording;
- "T" abutting "T" (FIG. 12): synchronize the tones and switch on the peaks. The switches of both tones preferably occur on either the positive or negative peaks, as appropriate, and preferably should not occur on opposing peaks. Varying amounts of overlap of the recordings can be used to adjust speed of playback or as needed (FIG. 13). This can be dynamic.
- "N" abutting "N" (FIG. 14): there are no synchronization points and the switches can occur anywhere within the noise provided no more than about 50% of duration of either of the noises is cut.
- "T" abutting "I" (FIG. 15): the switch occurs on a peak of the tone and on the impulse of the impulse recording. Varying amounts of overlap of the recordings can be used to adjust speed of playback or as needed (FIG. 16). This can be dynamic.
- "N" abutting "I" (FIG. 17): switch anywhere within the noise, provided no more than about 50% of the noise is cut, and switch on the impulse of the new impulse recording.
- "N" abutting "T" (FIG. 18): switch anywhere within the noise, provided no more than 50% of the noise is cut, and switch on a peak of the tone.

Figure 20:
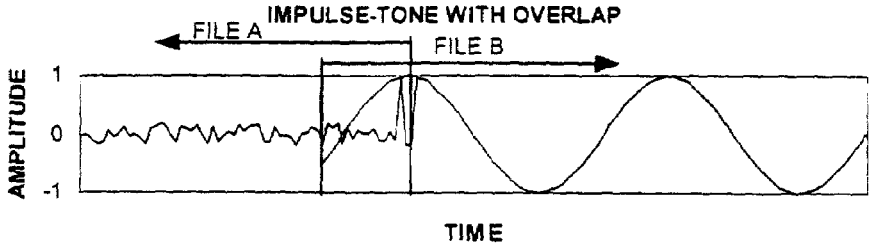
FIG. 20 graphically represents concatenation of an impulse and a tone with overlap.
Figure 21:
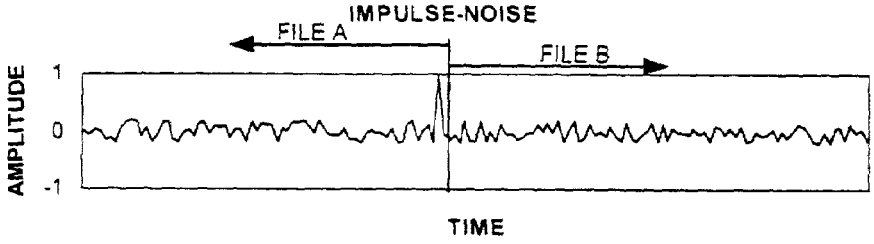
FIG. 21 graphically represents concatenation of an impulse and noise.
Figure 22:
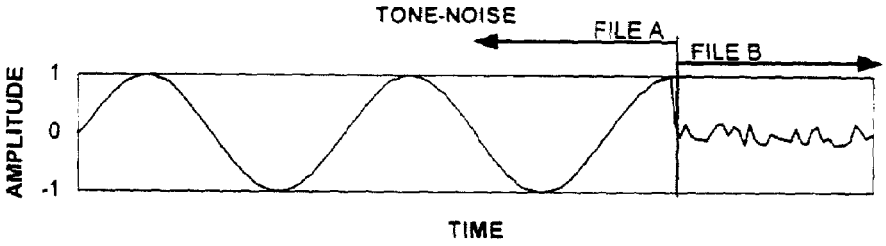
FIG. 22 graphically represents concatenation of a tone and noise.

"I" abutting "T" (FIG. 19): the switch occurs at a peak of the tone and at the end of the impulse recording. Varying amounts of overlap of the recordings can be used to adjust speed of playback or as needed (FIG. 20). This can be dynamic.

"I" abutting "N" (FIG. 21): switch to anywhere within the noise, provided no more than about 50% of the noise is cut, and switch at the end of the impulse of the new impulse recording.

"T" abutting "N" (FIG. 22): switch to anywhere within the noise, provided no more than about 50% of the noise is cut, and switch on a peak of the tone.

As can be seen from the above, and particularly from FIGS. 11-22, the present invention thus provides a more natural sounding concatenated speech output. In that regard, as previously described, in existing systems, to generate concatenated speech, voice files are simply butted together, without regard to the audio content of those files. As a result, in existing systems, where the end of the first voice file and the beginning of the next voice file both include the same impulse or tone sound, such impulse or tone sound is distinctly heard twice, which can sound unnatural. According to the present invention, however, the same impulse or tone sound occurring at the end of one voice file and the beginning of the next voice file, for example, will be synchronized so that such impulse or tone sound will be heard only once. That is, that same impulse or tone sound will be blended from the end of the first voice file into the beginning of the next voice file, thereby producing a more natural sounding concatenated speech output.

In a preferred embodiment, the blending of the first voice file and the second voice file is achieved via multiplexing (that is, the feathering of the first and second voice files.) For example, during the region of overlap between the first and second voice files, the system alternates rapidly (that is, a small portion of the first voice file, followed by a small portion of the second voice file, followed by a small portion of the first voice file, followed by a small portion of the second voice file, etc.) between the files so that sound that is effectively heard by an end listener is a blending of the two sonic features. Again, although various portions of this description make reference to voice files, the invention is readily applicable to streams or other suitable formats and the word "file" is not intended to be limiting.

In generating a concatenated speech output, the system and method of the present invention, in preferred implementations, play back various versions of recordings according to the surrounding recordings beginning or ending phonetics. The present invention thus allows for concatenated voice playback which maintains proper ligatures when connecting sequential voice recordings, using multiple versions of recordings with a variety of ligatures to capture natural human speech ligatures. That is, a particular item in the digital voice library may have a set of recordings for each, of several, inflections. Each recording in a particular set represents a particular ligature.

For the numerous voice recordings needed for a large concatenated voice system, the present invention provides for recording each word or phrase (or other item depending on the scaling and architecture) voice file (recording) staged with a ligature of two or more types of phonemes (these can be attached to full words) such that a segment of the recording can be removed from between staging elements. The removed affected recording segment contains distortions at the points of staging that contain ligature elements needed for reassembly of the isolated recordings. For example, consider an example having three types of sound types that are used for classification:

V=vowel;

C=consonant;

F=fricative consonant (fricative); and

_=no staging.

If a word to be recorded has a vowel at both beginning and end, then 16 versions of each recording are possible (for each pitch inflection recording in a complete system, but left out of this example for clarity). Each version will have two words (or no word) surrounding it for recording purposes. The preceding word may end in either a vowel or consonant or fricative or nothing, and the following word may begin in either a vowel or consonant or fricative or nothing. For the example word "Ohio," the following results:

| Stagings | | |
|---|---|---|
| the | Ohio exit | VV |
| the | Ohio cat | VC |
| the | Ohio fox | VF |
| the | Ohio | V_ |
| cat | Ohio out | CV |
| cat | Ohio cat | CC |
| cat | Ohio fox | CF |
| cat | Ohio | C_ |
| tuff | Ohio out | FV |
| tuff | Ohio cat | FC |
| tuff | Ohio fox | FF |
| tuff | Ohio | F_ |
| | Ohio out | _V |
| | Ohio cat | _C |
| | Ohio fox | _F |
| | Ohio | ___ |

Using these recordings, the appropriate version of a recording of the word "Ohio" can then be dropped into a sequence of other recordings between two words of similar beginnings and endings to the staging. In the above example, "Ohio" could also be a phrase, such as "on the expo."

The distortions are recorded with each recording such that when placed in the same or similar sound sequence, a more natural sounding result will occur. In the event that not all recording variations are needed or desired, the primary types of sounds that are affected are vowels at either end of the target word or phrase being recorded. Thus, for the minimum number of recordings, a target word with consonants at both ends, such as "cat", would only need recordings that had no surrounding ligature distortions included (as "___" above). A target word with a consonant at the beginning and a vowel at the end, such as "bow", would only need C, V and F end ligatures and one with no surrounding staging distortions. A target word with a vowel at the beginning and a consonant at the end, such as "out" would be the inverse of "bow," only needing C, V and F beginning ligatures and one with no surrounding staging distortions. Further reduction in recordings could be accomplished by placing distortions at only the beginning or at only the end of words.

Theoretically, staging could be used for every conceivable type of phoneme preceding or occurring after the target word, thereby setting the maximum number of recordings. As a mid-point between the minimum and maximum number of recordings, a number of recording classification limited set of phonetic groups could also be used such as plosives, fricatives, affricates, nasals, laterals, trills, glides, vowels, diphthongs and schwa, each of which are well known in the art. In that regard, plosives are articulated with a complete obstruction of the mouth passage that blocks the airflow momentarily. Plosives may be arranged in pairs, voiced plosives and voiceless plosives, such as /b/ in bed and /p/ in pet. Voiced sounds are produced with the vocal folds vibrating, opening and closing rapidly, thereby producing voice. Voiceless sounds are made with the vocal folds apart, allowing free airflow therebetween. Fricatives are articulated by narrowing the mouth passage to make airflow turbulent, but allowing air to pass continuously. As with plosives, fricatives can be arranged in pairs, voiced and voiceless, such as /v/ in vine and /f/ in fine. Affricates are combinations of plosives and fricatives at the same place of articulation. The plosive is produced first and released into a fricative, such as /tS/ in much. Nasals are articulated by completely obstructing the mouth passage and at the same time allowing airflow through the nose, such as /n/ in never. Laterals are articulated by allowing air to escape freely over one or both sides of the tongue, such as /l/ in lobster. Trills are pronounced with a very fast movement of the tongue tip or the uvula, respectively, such as /r/ in rave. Glides are articulated by allowing air to escape over the center of the tongue through one or more strictures that are not so narrow as to cause audible friction, such as /w/ in water and /j/ in young. Glides can also be referred to as approximants or semivowels. In addition, it is known that speech sounds tend to be influenced by surrounding speech sounds. In that regard, "co-articulation" is defined as the retention of a phonetic feature that was present in a preceding sound, or the anticipation of a phonetic feature that will be needed for a following sound. "Assimilation" is a type of co-articulation, and is defined as a feature where the speech sound becomes similar to its neighboring sounds. A hybrid can also be used that will have numerous versions for the most frequently used words and less versions for less frequently used words. This also works for words assembled from phonemes and syllables, and in all spoken languages.

As also previously noted, existing concatenated speech systems have historically been limited to outputting numbers and other commonly used and anticipated portions of an entire speech output. Typically, concatenated speech systems use a prerecorded fragment of the desired output up to the point at which a number or other anticipated piece is reached, the concatenation algorithms then generate only the anticipated portion of the sentence, and then another prerecorded fragment can be used to complete the output.

The present invention, however, utilizes an algorithm that works over the entire length of the required output, without the limitation of only accounting for specific and anticipated portions of a required output. In so doing, the present invention provides a system and method through which inflection shape, contextual data, and part of speech are factors in controlling voice prosody for text-to-voice conversion.

More particularly, the present invention comprises a prosody algorithm that is capable of handling random and unanticipated text streams. The algorithm is functional using anywhere from two inflection categories to hundreds of inflection types in order to generate the target output. The beginning and end of each phrase or sentence has been defined and is dependent on the type of sentence: statement, question, or emphatic. Within the body of the phrase or sentence, all connective or glue words in a preferred embodiment are generally mapped to a decreasing inflection category (by default or to whatever inflection category is needed to mate with surrounding words), in other words, one that points in a downward direction. Glue word categories have been identified as conjunctions, article, quantifiers, prepositions, pronouns, and short verbs. In those categories, glue words may be individual words having either one or more pronunciations, and glue phrases may be phrases composed of multiple glue words. Exemplary glue word and glue phrases include the following:

| Single glue words having a single pronunciation: | | | | |
|---|---|---|---|---|
| about | but | nor | that | whereas |
| across | concerning | not | themselves | wherever |
| after | during | of | these | which |
| against | each | off | this | whoever |
| all | even | on | those | with |
| and | except | once | throughout | without |
| an | for | one | till | yet |
| another | have | or | toward | yourself |
| around | herself | ourselves | under | |
| as | if | over | unless | |
| at | is | past | until | |
| because | in | rather | upon | |
| been | it | several | used | |
| behind | like | since | use | |
| beneath | myself | some | when | |
| beside | next | such | what | |
| between | none | than | whenever | |

| Single glue words having multiple pronunciations: | | | |
|---|---|---|---|
| a | every | now | though |
| although | everybody | she | through |
| anybody | few | so | to |
| be | he | solely | we |
| before | into | somebody | where |
| by | many | the | while |
| do | may | they | who |
| | | | you |

| Glue phrases: | | | |
|---|---|---|---|
| and a | each other | next to | solely to |
| and do | even if | not have | that the |
| and the | even though | now that | there is a |
| as if | for the | of the | to be |
| as though | have been | of this | to the |
| at the | if only | on the | use of |
| before the | in the | one another | used for |
| by the | is a | rather than | with the |
| do not | may not | so that | |

The single glue words listed above as having multiple pronunciations are described in that fashion because they are typically co-articulated as a result of the fact that they end in a vowel sound. That is, articulation of each of those words is heavily affected by the first phoneme of the immediately following word. In that regard, then, the list of single glue words having multiple pronunciations is an exemplary list of glue words where co-articulation is a factor only at the end of the word.

Words immediately following glue words or phrases are generally mapped to an increasing inflection category (by default or to whatever category is needed to mate with surrounding words), in other words, one that points in an upward direction, unless the placement of such words require the application of the mapping configuration for the end of a sentence. Note that the glue words and phrases identified above are an indication of words and phrases that can be defined as glue words and phrases depending on their contextual positioning. This list is not intended to be all inclusive; rather it is an indication of some words that can be included in the glue word category. In addition, the above lists of glue words and glue phrases is exemplary for the English language. Other languages will have their own set of glue words and glue phrases.

As is readily apparent from the foregoing description, the present invention provides an improved system and method for converting text-to-voice which accepts text as an input and provides high quality speech output through use of multiple human voice recordings. The system and method include a library of human voice recordings employed for generating concatenated speech, and organize target words and syllables such that their use in an audible sentence generated from a computer system sounds more natural. The improved text-to-voice conversion system and method are able to generate voice output for unknown text, and manipulate the playback switch points of the beginnings and endings of recordings used in a concatenated speech application to produce optimal playback output. The system and method are also capable of playing back various versions of recordings according to the beginning or ending phonetics of surrounding recordings, thereby providing more natural sounding speech ligatures when connecting sequential voice recordings. Still further, the system and method work over the entire length of the required output, without the limitation of only accounting for specific and anticipated portions of a required output, using inflection shape, contextual data, and speech parts as factors in controlling voice prosody for a more natural sounding generated speech output. Moreover, the present invention is not limited to use with any particular audio format, and may be used, for example, with audio formats such as perceptual encoded audio, Linear Predictive Coding (LPC), Codebook Excited Linear Prediction (CELP), or other methods that are parametric or model based, or any other formats that may be used in either text-to-speech or text-to-voice systems.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for converting text to concatenated voice by utilizing a digital voice library and a set of playback rules, the digital voice library including a plurality of speech items and a corresponding plurality of voice recordings wherein each speech item corresponds to at least one available voice recording, multiple voice recordings corresponding to a single speech item representing various inflections of that single speech item, the method comprising:

establishing multiple voice recordings in the digital voice library that correspond to a single inflection of a single speech item, for a plurality of inflections of a plurality of speech items, that represent various ligatures for the single inflection of the single speech item with adjacent speech items wherein the recordings for a single inflection of a single speech item are a limited set of recordings that represent a limited set of ligatures with adjacent speech items including only recordings having a vowel at either end and recordings having no surrounding ligature distortions;

receiving text data;

expanding the text data to form a sequence of text and pseudo words;

converting the sequence of text and pseudo words into a sequence of speech items in accordance with the digital voice library, wherein at least one speech item in the sequence of speech items corresponds to multiple voice recordings;

converting the sequence of speech items into a sequence of voice recordings in accordance with the set of playback rules, wherein selecting a voice recording where multiple voice recordings are available for a speech item is based on context around the speech item in the text data;

generating voice data based on the sequence of voice recordings by concatenating adjacent recordings in the sequence of voice recordings;

wherein the plurality of speech items includes a plurality of phrases, and wherein converting the sequences of text and pseudo words further includes parsing the sequence of text and pseudo words to determine any phrases.

2. The method of claim 1 wherein expanding the text data further comprises:

searching the text data for an abbreviation; and expanding any abbreviation contained in the text data into at least one pseudo word.

3. The method of claim 1 wherein expanding the text data further comprises:

searching the text data for a numerical suffix; and expanding any numerical suffix contained in the text data into at least one pseudo word.

4. The method of claim 1 wherein expanding the text data further comprises:

searching the text data for a telephone number; and expanding any telephone number contained in the text data into at least one pseudo word.

5. The method of claim 1 wherein expanding the text data further comprises:

searching the text data for a number that includes a comma; and expanding any number that includes a comma contained in the text data into at least one pseudo word.

6. The method of claim 1 wherein expanding the text data further comprises:

searching the text data for an Internet mail address; and expanding any Internet mail address contained in the text data into at least one pseudo word.

7. The method of claim 1 wherein expanding the text data further comprises:

searching the text data for an Internet Universal Resource Locator; and expanding any Internet Universal Resource Locator in the text data into at least one pseudo word.

8. The method of claim 1 wherein the plurality of speech items includes a plurality of words, and wherein converting the sequence of text and pseudo words further comprises:

parsing the sequence of text and pseudo words to determine any words.

9. The method of claim 8 wherein the plurality of speech items includes a plurality of syllables, and wherein converting the sequence of text and pseudo words further comprises:

parsing the sequence of text and pseudo words to determine any syllables.

* * * * *